United States Patent [19]

Weinberg

[11] Patent Number: 4,530,221

[45] Date of Patent: Jul. 23, 1985

[54] ATTACHMENT ADAPTED FOR USE WITH DIFFERENT NECKLACES

[76] Inventor: Joshua Weinberg, 157 NE. 166 St., North Miami Beach, Fla. 33162

[21] Appl. No.: 530,706

[22] Filed: Sep. 9, 1983

Related U.S. Application Data

[63] Continuation-in-part of Ser. No. 472,633, Mar. 7, 1983, abandoned.

[51] Int. Cl.[3] ..... A44C 25/00

[52] U.S. Cl. ..... 63/2; 24/116 A; 63/23

[58] Field of Search ..... 63/1, 2, 20, 23; 24/68 J, 116 A, 116 R, 136 R, 350

[56] References Cited

U.S. PATENT DOCUMENTS 1,578,940 3/1926 Wacha ..... 63/2

FOREIGN PATENT DOCUMENTS 1248047 10/1960 France ..... 24/116 A

*Primary Examiner*—F. Barry Shay

*Attorney, Agent, or Firm*—John Cyril Malloy

[57] ABSTRACT

An attachment device designed to be removably secured to a strand of pearls or like necklace, such as a gold chain or the like, for the purpose of shortening the effective length of the strand and/or adding an additional decorative gem in a depending fashion to the strand or necklace. A casing includes one or two sockets each of which are structured to at least partially enclose a single pearl or engage a necklace along its length wherein two pearls or other necklace portions along the length of the strand may be engaged by the attachment device thereby shortening the length. A decorative gem attached to the exterior surface of the casing may be added to the strand by securing one or two pearls within one or two sockets of the casing thereby adding to the aesthetic appearance of the strand in a non-permanent manner.

7 Claims, 33 Drawing Figures

ATTACHMENT ADAPTED FOR USE WITH DIFFERENT NECKLACES

BACKGROUND OF THE INVENTION

This is a continuation-in-part of presently pending application Ser. No. 472,633, filed Mar. 7, 1983, now abandoned.

FIELD OF THE INVENTION

This invention relates to an attachment device which is removably securable to a strand of pearls or like jewels for the purpose of removably attaching a decorative object and further attachable in such a fashion as to effectively shorten the strand of pearls when desired.

DESCRIPTION OF THE PRIOR ART

The popularity of necklaces such as gold chains and pearls as a decorative article of jewelry has of course accomplished wide acceptance. Commonly, pearls are worn in strands wherein the individual pearls are interconnected to one another along a supporting stand of varying predetermined length. When such strands of pearls are of sufficient length they are commonly worn as a necklace. However, depending on the original length, it is frequently desired by the wearer to shorten or otherwise alter the length and thereby change the aesthetic appearance of the strand. This is accomplished frequently by doubling the strand over upon itself or otherwise repetitively circling the wearer's neck. Similarly, it is frequently desired to shorten the length of gold chain type necklaces or otherwise add to the aesthetic appearance by varying the configurations of such necklaces when placed around the neck of the wearer.

Other attempts have been made to alter or more specifically enhance the aesthetic appearance of necklaces and strings of pearls by adding a decorative gem, stone, or like element to the clasp. However, such additions are usually permanent and generally cannot be detached at will.

Accordingly, there is a need for an attachment device or like structure capable of being removably secured to a strand of pearls or other necklaces such as gold chains in a manner which will allow a predetermined shortening of the overall length and/or add variety to the aesthetic appearance of the strand by adding a decorative element or the like.

SUMMARY OF THIS INVENTION

The present invention is directed towards an attachment device of the type particularly designed to be removably mounted on a necklace including a gold chain, string of pearls or like interconnected jewels. It should be noted that while the present invention is described in large part with reference to a strand of pearls wherein the pearls are interconnected to one another along a supporting strand having a predetermined length, necklaces of a gold chain and other jewels such as similarly formed gem stones can be used with the present invention.

The subject attachment device comprises a casing including a substantially continuous cylindrical wall. The wall defines the exterior boundaries of a socket means. The socket means may include one or two sockets each of which are specifically structured to at least partially enclose a length of a necklace, single pearl or other gem therein. The socket means includes an open end allowing passage therethrough of necklace portio or a pearl into each of the sockets.

The subject attachment device further comprises locking means which in the various embodiments of th present invention include structure which is movabl securable to the casing in substantially covering relatio to the open end of each socket. This positioning serve to effectively block the inadvertent removal of a pear from the interior of a given socket. By virtue of th selective positioning of the locking means, the attch ment device can be readily and efficiently attached o removed from the individual pearls of a strand thereb effectively accomplishing the intended purpose of th attachment device.

An important feature of the present invention is in corporated in the embodiment comprising the casin wall defining two contiguously disposed sockets. I such embodiment, individual pearls located a predeter mined spaced apart distance along the length of th strand are enclosed and "locked" in the respective sock ets. Since the enclosed pearls are thereby located in side-by-side relation to one another, the effect is t shorten the length by creating two "loops." When it i desired to resume the original length of the strand o again change its size, the attachment device can b repositioned and/or entirely removed from the stran as desired.

Alternately, the two contiguously disposed socket may have a channel or passage aperture formed therei specifically configured to accept a necklace or strand o pearls with varying configurations. Accordingly, a fla chain or a round rope-like chain necklace as well a strands of pearls may be secured within separate socket wherein the specifically formed apertured channels o passages are adapted to engage and secure the variou configurations of the necklace involved.

Another embodiment of the present invention in cludes the casing defining a single socket. In this em bodiment, locking means as described above also allow for the convenient mounting and detachment of th attachment device from a single pearl anywhere alon the length of the strand. In addition however, a decora tion means preferably in the form of a decorative gen stone or like element is fixedly secured to the casing an is disposed thereon to add additional decoration both t the attachment device and to the overall appearance o the necklace or pearl strand. Therefore, an additiona gem stone or like decorative element can readily b attached in a pendant like fashion. This allows a variet in the aesthetic appearance of a given necklace merel by changing the location of the attached decorativ element or by securing one or more different decorativ elements along the length, to individual pearls, as de sired.

The invention accordingly comprises the features o construction, combination of elements, and arrange ments of parts which will be exemplified in the con struction hereinafter set forth, and the scope of th invention will be indicated in the claims.

BRIEF DESCRIPTION OF THE DRAWINGS

For a fuller understanding of the nature of the presen invention, reference should be had to the followin detailed description taken in connection with the ac companying drawings, in which.

Similar reference characters refer to similar parts throughout the several views of the drawings.

DESCRIPTION OF THE PREFERRED EMBODIMENT

Figure 1:
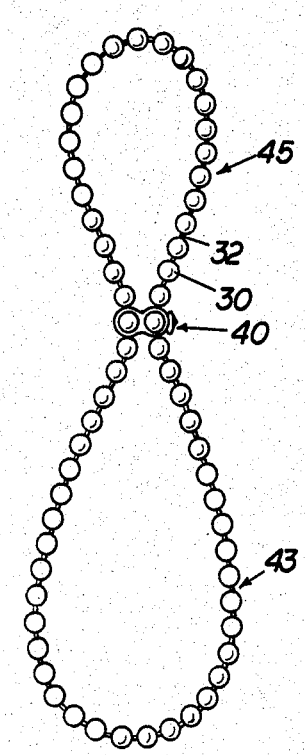
FIG. 1 is a front elevational view of one embodimen of the present invention mounted on a strand of pearls
Figure 2:
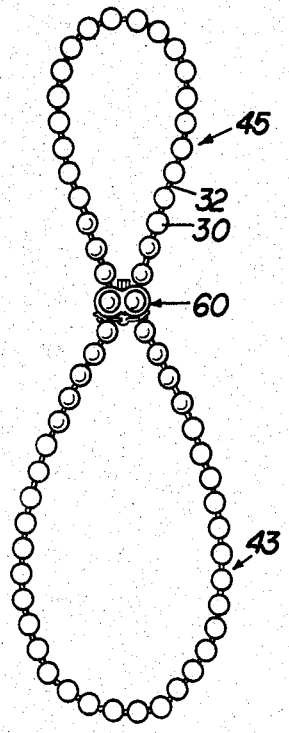
FIG. 2 is a front elevational view of yet another embodiment of the present invention mounted on a strand of pearls.
Figure 3:
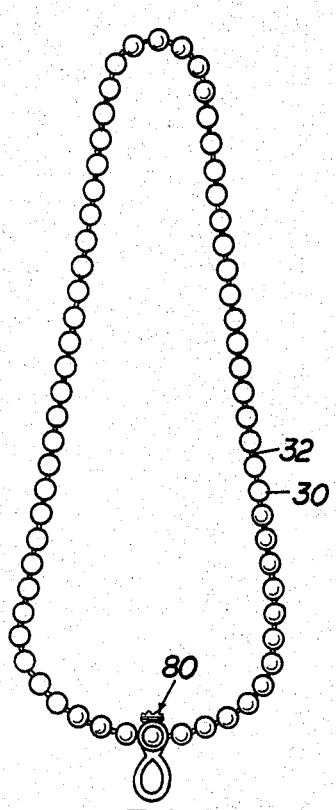
FIG. 3 is a front elevational view of yet another embodiment of the present invention mounted on a strand of pearls.
Figure 4:
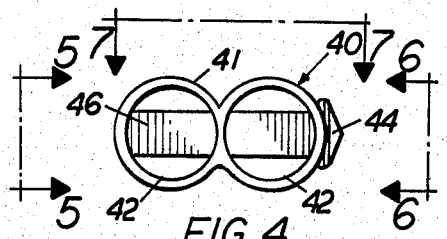
FIG. 4 is a front elementional view of one embodiment of the attachment means.
Figure 5:
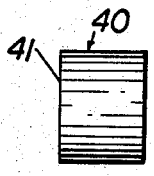
FIG. 5 is an end view taken along line 5—5 of FIG. 4.
Figure 18:
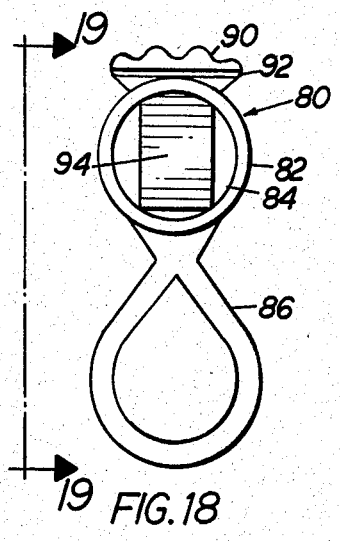
FIG. 18 is a front plane view of yet another embodiment of the present invention.
Figure 19:
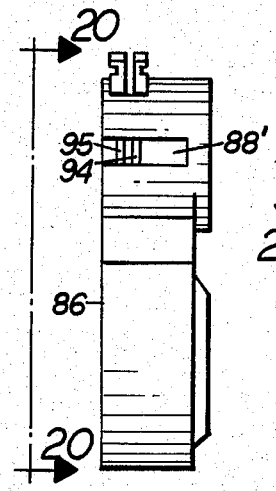
FIG. 19 is a side view taken along line 19—19 of FIG. 18.
Figure 20:
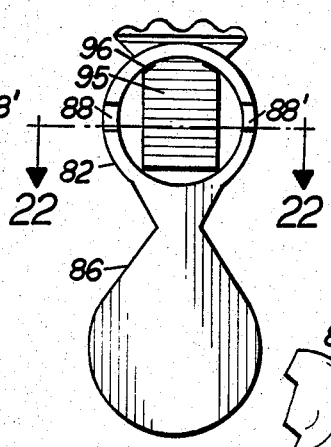
FIG. 20 is a bottom view taken along line 20—20 of FIG. 19.
Figure 21:
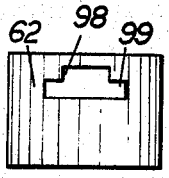
FIG. 21 is an end view showing structural details of securement of the locking structure to the embodiment of FIG. 18.
Figure 22:
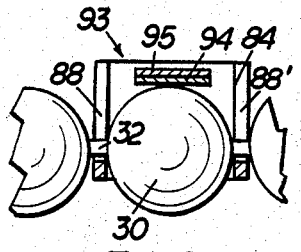
FIG. 22 is a secitional view along line 22—22 of FIG. 20.
Figure 23:
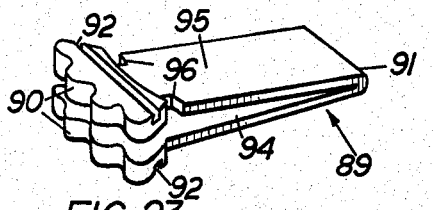
FIG. 23 is an isometric view of a locking structure of the embodiment of FIG. 18.

As shown in FIGS. 1, 2 and 3, the jewelry attachment device of the present invention is generally indicated in its various embodiments as 40, 60 and 80. As shown, the attachment device is primarily designed for use in connecting individual pearls or like jewels in a strand of jewels for the purpose of shortening the overall length of the strand and/or adding a decorative gem or like object 86 (FIG. 18) to the strand at a designated point along its length (FIG. 3).

With regard to the embodiment of FIG. 1, the attachment device 40 comprises a casing 41 including socket means comprising two sockets 42. Each socket 42 is disposed in direct adjacent and/or contiguous relation to one another and each is specifically dimensioned and configured to at least partially enclose a single pearl 30 therein. Again with reference to FIG. 1 wherein the individual pearls which are enclosed in the individual sockets 42 are a predetermined spaced apart relation to one another (FIGS. 1 and 2). An effective or primary loop generally indicated as 43 is formed which effectively shortens the overall length of the strand of pearls from its original length as indicated in FIG. 3. The secondary loop 45 can be disposed on the wearer in any of a number of additional ornamental positions thereby adding to the overall aesthetic appearance and versatility of a single strand. Further with regard to the embodiment of FIG. 1, the casing 41 is defined by a substantially cylindrical wall 41 which is constructed to define the exterior boundary of each of the sockets 42.

Figure 7:
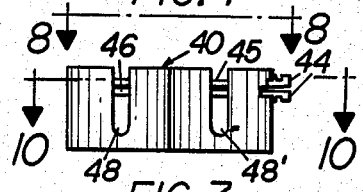
FIG. 7 is a side elevational view taken along line 7—7 of FIG. 4.

Passage means comprising at least a first and second channel 48 and 48' are provided as part of each socket 42 wherein the first and second channels 48 and 48' are integrally formed in the wall 49 of casing 41. More specifically, each of the first and second channels have an open end construction (FIG. 7) at one end and a closed end construction at the other. The opposed disposition of the channels 48 and 48' allows placement therein of support strand portions 32 extending out of the opposite sides of the at least partially enclosed individual pearls 30 placed within the individual sockets 42. Therefore, the individual pearls are allowed to be at least partially enclosed and easily and conveniently seated within each of the sockets 42 and prevent it from passing through one open end of the socket 42 as clearly shown.

Figure 10:
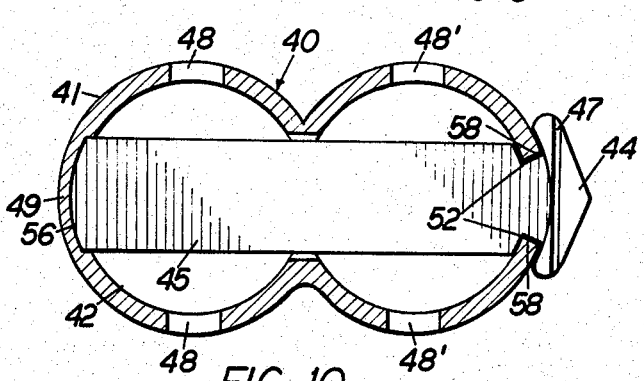
FIG. 10 is a sectional view taken along line 10—10 of FIG. 7.
Figure 11:
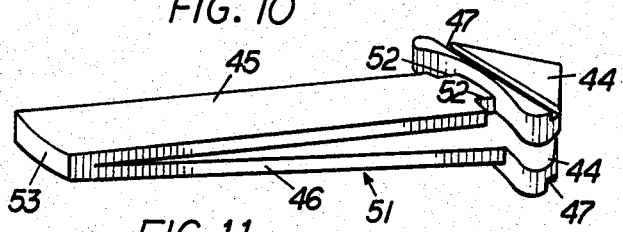
FIG. 11 is an isometric view showing structural details of a locking structure of the present invention.
Figure 9:
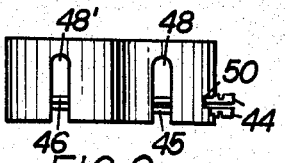
FIG. 9 is a bottom view of the embodiment of FIG. 4.
Figure 12:
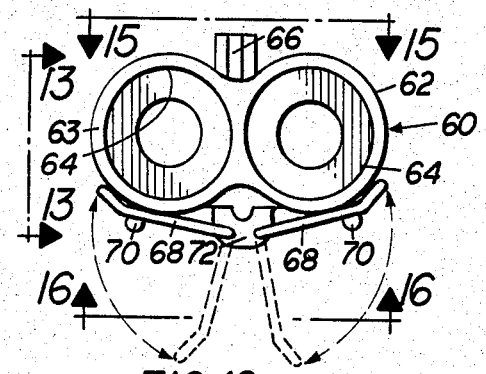
FIG. 12 is a front elevational view of yet another embodiment of the attachment device of the present invention.
Figure 13:
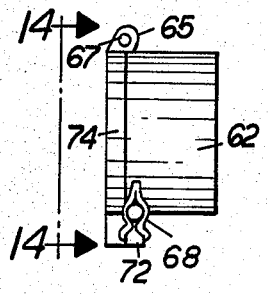
FIG. 13 is an end view taken along line 13—13 of FIG. 12.
Figure 14:
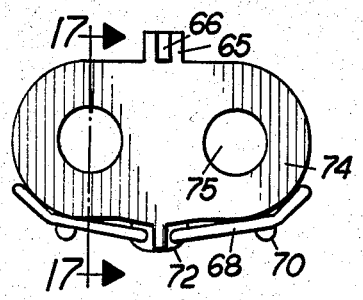
FIG. 14 is a bottom view taken along line 14—14 of FIG. 13.
Figure 15:
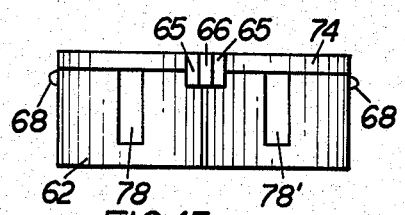
FIG. 15 is a side view taken along line 15—15 of FIG. 12.

A locking means generally indicated as 51 (FIG. 11) in the embodiment of FIG. 1 is specifically structured to at least partially cover the oppositely disposed open end and be positioned in substantially overlying relation to each of the enclosed pearls 30 in the individual sockets 42. Placement of the locking means 51 is accomplished by positioning the distal end 53 within a properly configured and dimensioned slot 50 integrally formed in the casing wall 49 as shown in FIGS. 9 and 10. As shown in FIG. 11, the locking means comprises a generally elongated configuration and includes spaced apart tongue members 45 and 46 integrally secured to one another at distal end 53 and thereby forming an inherent biasing or spring means. The structure of the individual tongue members 45 and 46 is such that these members are normally biased or positioned in spaced apart relation to one another as shown in FIG. 11. Handle means 44 are specifically structured to include a grasping groove 47 integrally formed therein wherein fingernails or a tool can be securely positioned within the grasping grooves 47 so as to slide the locking means 51 out of slot 50 when it is desired to remove the locking means from the casing 41 in order to remove the individual pearls 30 from the individual sockets 42. In order to adequately secure the locking means 51 within the slot in its locking position as shown in FIG. 10, the distal end 53 is placed within a recess portion 56 integrally formed on the interior surface of one of the sockets 42 as shown. This recess 56 is aligned with but oppositely disposed relative to the entrance slot 50 formed in the casing wall 49 as described above and further shown in FIGS. 9 and 10. Further structural details of the locking means 51 include detent means 52 formed in the proximal end of at least one of the tongue members 45 immediately adjacent the handle 44. This detent means 52 is used to engage the peripheral outwardly extending flanges 58 (FIG. 10). Once the tongue elements 45 and 46 are placed in their enclosed or locking position as shown in FIG. 10, the handle means 44 are released and the inherent bias of the locking means forces the placed apart disposition of the two tongue elements 45 and 46. Accordingly, the detents 42 lockingly engage the peripheral flanges 58. When it is desired to remove the locking means from its locking position as shown in FIG. 10, fingernails or auxiliary tools are placed within the grasping grooves 47 and the two handles 44 (FIG. 11) are depressed or squeezed together so as to remove the detent means 52 from the peripheral flanges 58. The tongue elements 45 and 46 are then merely slid through the entrance slot 50 and the locking means 51 is entirely removed from the closing or locking position relative to the enclosed pearls.

Figure 16:
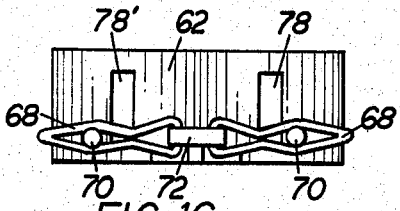
FIG. 16 is a side view taken along line 16—16 of FIG. 12.
Figure 17:
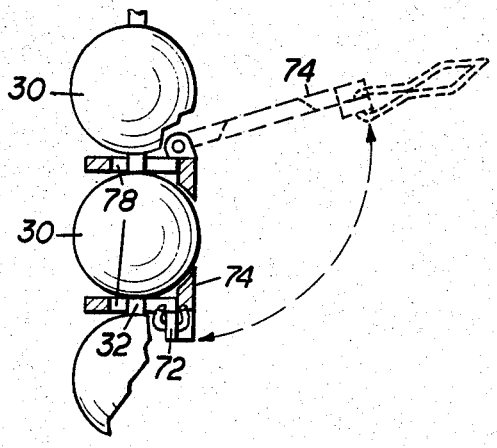
FIG. 17 is a sectional view in partial cutaway along line 17—17 of FIG. 14.

With regard to the embodiment of FIG. 2, the attachment device generally indicated as 60 comprises (FIGS. 12 through 17) a casing means 62 including a cylindrical wall 63 defining the outer peripheral boundary of each of the sockets 64 defining the socket means. This structure is similar to the embodiment of FIG. 1 in that each of the sockets 64 are specifically dimensioned and structured to house an individual pearl 30 or like jewel therein. Similarly, a passage means comprising a first and second open ended channel 78 and 78' are integrally formed in the casing wall 63 in opposed relation to one another. As with the embodiment of FIG. 1, the first and second open ended channels 78 and 78' are specifically disposed and structured to allow passage therein of supporting strand portions 32 extending outwardly from the opposite sides of the at least partially enclosed pearl 30 (FIG. 17). Therefore, the individual enclosed pearl 30 disposed in each socket 64 is prevented from passing out of one of the open ends generally indicated as 65 since the supporting strand portions 32 are blocked from passage therethrough due to the closed end of the individual first and second channels 78 and 78'. The locking means of the embodiment of FIG. 1 comprises a lid member 74 configured to at least partially enclose the opposite open end, from open end 65, of each of the individual sockets 64. This lid 74 is hingedly connected as at 65 to the casing so as to be pivotal between an open and closed position. The hinge means 65 is secured by a locking pin as at 67 passing through an additional hinge member 66. Therefore, when it is desired to maintain the individual pearls 30 in the individual channel 64, the lid member 74 is disposed from its open positions, represented in broken lines in FIG. 17, to its closed or locking position represented in solid lines in FIG. 17. Latch means comprising at least two latch elements 68 are movably connected as at 72 to the front portion of the lid element 74. These latch elements 68 are apertured as best shown in FIG. 16 and are positionable into a snap fit with protruding fingers 70 extending outwardly from the exterior surface of the casing wall 63. Therefore, the latch element 68, when in their snap fitted or closed position over finger 70 act as a safety latch to secure the lid 74 in its locking or closed position and thereby maintain the individual pearls 30 within their individual sockets 64.

Further structural features of the lid element 64 include apertures 75 used to allow visual access to the enclosed pearls 30. The lid element may be further structured to support an additional decorative gem or like decorative object thereon to additionally enhance the aesthetic appearance of the attachment device once it is in place on the strand by engaging spaced apart individual pearls 30 as best shown in FIG. 2.

With regard to the embodiment of FIG. 3, attention is directed to FIGS. 18 through 23 wherein the attachment device 80 comprises a casing means including a cylindrical casing wall 82 defining the exterior boundaries of a single socket 84. This single socket, as with the embodiments described above, is dimensioned and structured to at least partially enclose an individual pearl 30. Further, passage means are provided and include a first and a second oppositely disposed but substantially aligned channel 88 and 88'. An individual pearl 30 (FIG. 22) is disposed within the individual socket 34 such that the supporting strand portions 32 extend outwardly from the open ended channels 88 and 88'.

A locking means incorporated in this embodiment of the present invention is best shown in FIG. 3 and generally represents the structure of the embodiment of FIG. 1 as best shown in FIG. 11. More specifically, the locking means is generally indicated as 89 and includes a distal end 91 serving as the joining point or junction of the tongue elements 94 and 95. These tongue elements are normally disposed in a biased, spaced apart relation to one another and each has integrally attached thereto at its opposite end, a handle means 90. Each handle means 90 includes a grasping groove 92 which facilitates removal of the locking means 89. When positioned, the distal end 91 is placed within an entrance slot 99 (FIG. 21) and the tongue elements 94 and 95 are slid across the open end generally indicated as 93 (FIG. 22) until it is in substantially overlying and/or blocking relation to the enclosed pearl 30. Passage of the tongue elements 94 and 95 through the slot 99 causes their compression towards one another. Detent means 96 are disposed into locking engagement with the dependent peripheral flanges 98 (FIG. 21) such that locking engagement takes place preventing the inadvertent removal of the locking means 89 from its locking engagement and from exiting the slot 99.

Further structural features of the embodiment of FIGS. 18 through 23 comprise the addition of a decorative means or object 86 attached to the exterior surface of the casing wall 82 and disposed in depending relation therefrom. This decorative object 86 may comprise a decorative gem or any other like object which may overall enhance the appearance of the aesthetic versatility of the strand as best shown in FIG. 3.

Figure 24:
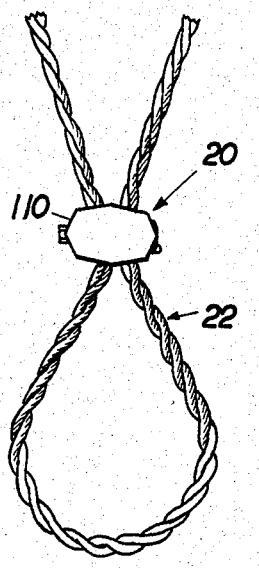
FIG. 24 is a front plan view of one embodiment of the present invention mounted on a rope chain necklace.
Figure 25:
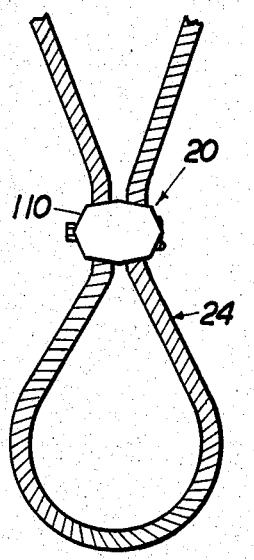
FIG. 25 is a front plan view of the embodiment of FIG. 24 mounted on a flat chain necklace.
Figure 26:
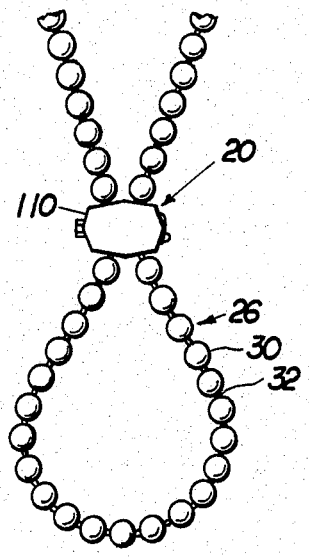
FIG. 26 is the embodiment of FIGS. 24 and 23 mounted on a pearl strand necklace.

As best shown in FIGS. 24 through 33, the present invention includes another embodiment comprising an attachment device generally indicated as 20 which is specifically structured to be attached to various portions along the length of different type necklaces 22, 24 and 26. More specifically, FIG. 24 shows a necklace in the form of a multiple strand rope chain. FIG. 25 shows a necklace in the form of a flat chain. FIG. 26 shows a necklace comprising a strand of pearls when the supporting strand 32 supports a plurality of pearls 30 disposed in successive relation to one another.

With reference to FIGS. 27 through 30, the attachment device of the present invention comprises a casing means including a continuous cylindrical casing wall 100 defining two contiguously disposed sockets 102 and 103 each having a hollow interior portion for the positioning and maintenance of a portion of the length of the necklaces as outlined in FIGS. 24 through 26.

Figure 8:
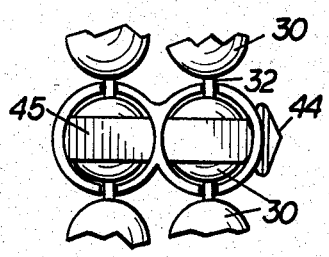
FIG. 8 is a front elevational view in partial cutaway showing the embodiment of FIG. 4 in attached relation to a strand of jewels.
Figure 27:
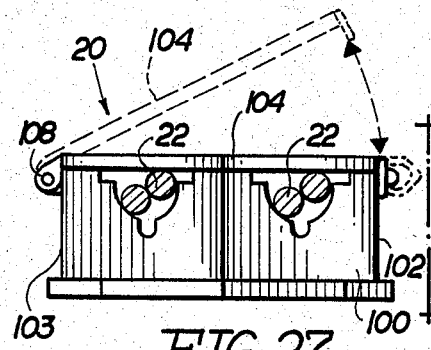
FIG. 27 is a side plan view in partial section of FIG. 24 with the lid structure shown in its open position represented in broken lines.
Figure 30:
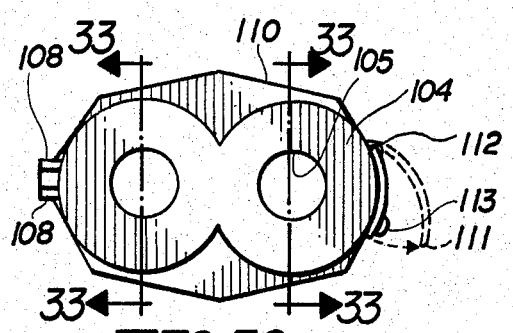
FIG. 30 is a bottom view of the embodiment of FIG. 27.
Figure 31:
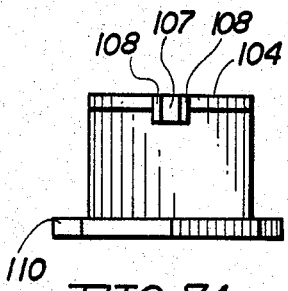
FIG. 31 is an end view along line 31—31 of FIG. 28.
Figure 32:
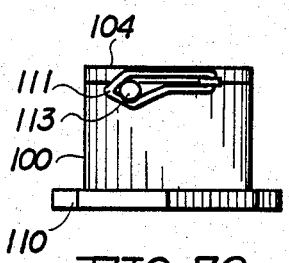
FIG. 32 is an end view along line 32—32 of FIG. 28.
Figure 33:
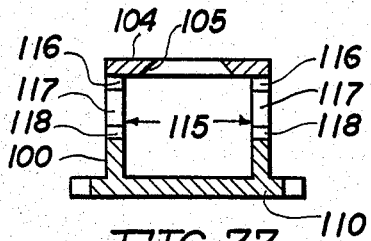
FIG. 33 is a sectional view along line 33—33 of FIG. 30.

The casing means further comprises a locking means in the form of lid portion 104 shown in open position and represented in broken lines in FIG. 27. The lid portion 104 is pivotally or hingedly connected as at 106 to one end of the casing means. As best shown in FIG. 8, the hinge structure includes the hinge casing 107 housing a pivot pin or like and two pivot links 108. Accordingly, the lid portion 104 has a sufficient longitudinal dimension and overall configuration to cover the open ends of each of the sockets 102 and 103 so as to maintain the portions of the length of the necklace therein. As best shown in FIGS. 30, 31 and 32, the casing means further includes a base 110 integrally attached to the remaining cylindrical wall 100 and having a somewhat planar configuration with a greater dimension than the bottom portion of the two sockets 102 and 103. Accordingly, the base 110 may serve as a decorative shield or the like as it faces forward when attached to a portion of the length of a necklace as shown in FIGS. 24 through 26.

Other structural features of the casing include the lid portion 104 including apertures 105 in the upper portion thereof so as to clearly communicate visually with the interior of each of the sockets. Also, in order to secure the lid 104 to the balance of the casing wall 100, a latch means is provided including a latch element 111 pivotally attached as at 112 to the opposite end of the lid 104 relative to the pivot connection as at 108. This latch element 111 may snap-fit over an outwardly projecting finger 113 which is mounted on the casing wall 100 secured at one end of the two sockets. This serves to physically secure the lid portion 104 in its closed position and maintain the enclosed necklace length portions within their individual respective sockets.

Figure 28:
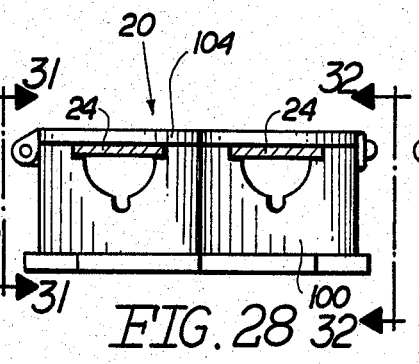
FIG. 28 is a side plan view in partial section of the embodiment of FIG. 25.
Figure 29:
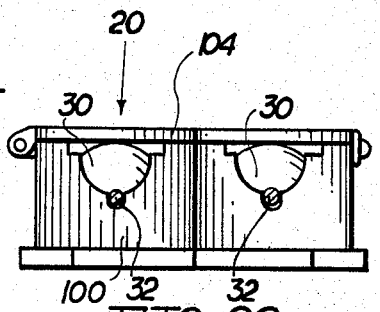
FIG. 29 is a side plan view of the embodiment of FIG. 26 in partial section.

An important structural feature of the present invention is best shown in FIGS. 27 through 29 and 33 wherein a passage means is integrally formed in the cylindrical casing wall 100 of each of the socket so as to effectively capture and maintain portions of the length of the necklace within their respective sockets. This passage means comprises two channels or channel apertures integrally formed in opposite wall portions of each socket. As shown in FIG. 10, each of the channel apertures are arranged in linearly aligned relation to one another and in this embodiment of the present invention, each channel aperture generally indicated as 115 includes a plurality of sections each having a different peripheral configuration to define the overall peripheral configuration of each channel aperture. More specifically, each channel aperture 115 includes a top section 116, a middle section 117, and a bottom section 118. It can readily be seen therefore with reference to FIGS. 27 through 29 that the peripheries of each of these three sections collectively define the periphery of the channel aperture 115. With reference to the individual sections, top section 116, as shown in FIG. 28, has a substantially elongated configuration specifically designed to house in fitting relationship and closely maintain therein a flat configured chain 24 of the type shown in FIG. 25. It can be seen that the flat chain has an overall substantially rectangular cross-sectional configuration which conforms to the periphery or overall configuration of the top section 116. When the lid 104 is in its closed position (FIG. 28) the chain is secured therein. With reference to FIG. 27, the middle section 117 has a substantially round configuration in that the opposite sides or edges of each channel aperture has a curvilinear configuration which are spaced apart from one another. This overall configuration is adequate to allow the aperture to maintain and surround the double or multi-strand rope chain necklace 22 as best shown in FIG. 27 and FIG. 24. Necklace 22 fits in sections 116 and 117 of the aperture and is held in contact with the aperture periphery (including lid 104) by at least three points.

Figure 6:
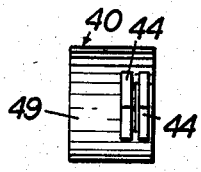
FIG. 6 is an end view showing details of a locking structure of the present invention taken along line 6—6 of FIG. 4.

With reference to FIG. 6, the bottom section 118 is specifically configured to be substantially semi-circular and a much smaller dimension than the substantially round or semi-circular middle section 117. This bottom section 118 is therefore specifically configured to have mounted and maintained therein a supporting strand 32 of the pearl necklace as shown in FIG. 26.

It can readily be seen therefore that the embodiment of FIGS. 24 through 33 is directed to an attachment device capable of being connected or mounted on a variety of configurations. As can be seen in FIG. 27, necklace part 22 fits the aperture in the sense that the latter is confined in contact with the aperture periphery at least three points.

What is claimed is:

1. An attachment device of the type designed for connection to at least one portion along the length of a necklace, said attachment device comprising:

(a) a casing including two sockets disposed in contiguous relation to one another and configured to receive a length portion of a necklace therein, a cylindrical casing wall having a substantially continuous configuration substantially defining the boundaries of each socket, (b) each of said sockets including a closed end and an open end, said open end dimensioned and configured for passage of a necklace length portion laterally therethrough, (c) locking means movably mounted on said casing and structured for at least partial covering of said open end of each socket to retain said length portions in said sockets, (d) passage means formed in each socket and configured and disposed for extension of a said length portion out of opposite sides of each socket, (e) said passage means comprising two channel apertures formed in said casing wall of each socket, said two channel apertures of each socket disposed in substantially aligned relation to one another and each channel aperture comprising a predetermined configuration structured to selectively receive and hold in generally fitting relationship any one of at least two of said length portions of different cross-sectional configurations, whereby any one of a plurality of necklaces of different configurations may be closely maintained within said sockets of said attachment device.

2. An attachment device as in claim 1 wherein each of said channel apertures of each socket are integrally formed in said casing wall of each socket and in substantially linearly aligned relation to one another, each of said channel apertures having a substantially equal peripheral configuration, said peripheral configuration including a plurality of sections, each section being configured differently from the other sections to allow each of said passage means to selectively receive any one of a pluarality of necklace length portions of substantially varied cross-sectional configuration.

3. An attachment device as in claim 1 wherein said locking means comprises a lid element configured and dimensioned to cover said open ends of both sockets when in a closed position, said lid element pivotally connected at one end of said casing.

4. An attachment device as in claim 1 wherein said plurality of sections of each channel aperture include a top section comprising a substantially elongated, linear configuration corresponding to a flat chain length po tion.

5. An attachment device as in claim 4 wherein sa plurality of sections of each channel aperture includes middle section comprising oppositely disposed, spac apart substantially equal curvilinear side peripher edges, whereby said apertures have a dimension capab of receiving a necklace having a cross section too lar to fit within said top section.

6. An attachment device as in claim 2 wherein sa plurality of sections of each channel aperture includes bottom section comprising a substantially semi-circul configuration substantially corresponding to a sing strand length portion of a circular cross-sectional co figuration.

7. An attachment device as in claim 6 wherein tl peripheral edges of each of said plurality of sectio collectively define the inner periphery of said chann aperture and each of said sections being contiguous to least one other section.

* * * * *